US007004283B2

(12) United States Patent
Wörner et al.

(10) Patent No.: US 7,004,283 B2
(45) Date of Patent: Feb. 28, 2006

(54) MULTIPLE-CHAMBERED EXHAUST MUFFLER

(75) Inventors: Siegfried Wörner, Esslingen (DE); Herbert Schumacher, Lichtenwald (DE); Norbert Klein, Neunkirchen (DE); Helmut Neu, Ottweiler (DE); Stephan Giebel, Lockweiler (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 414 days.

(21) Appl. No.: 10/257,818

(22) PCT Filed: Apr. 12, 2001

(86) PCT No.: PCT/EP01/04234

§ 371 (c)(1),
(2), (4) Date: Jul. 15, 2003

(87) PCT Pub. No.: WO01/79665

PCT Pub. Date: Oct. 25, 2001

(65) Prior Publication Data

US 2004/0003963 A1 Jan. 8, 2004

(30) Foreign Application Priority Data

Apr. 14, 2000 (DE) ..... 100 18 505
Nov. 22, 2000 (DE) ..... 100 58 142

(51) Int. Cl.
*F01N 7/08* (2006.01)
*F01N 1/24* (2006.01)
*F01N 1/02* (2006.01)
*F01N 1/06* (2006.01)

(52) U.S. Cl. ..... 181/239; 181/256; 181/257; 181/268; 181/269; 181/272; 181/275

(58) Field of Classification Search ..... 181/239, 181/238, 282
See application file for complete search history.

(56) References Cited

U.S. PATENT DOCUMENTS

| | | | | | |
|---|---|---|---|---|---|
| 3,776,366 | A | * | 12/1973 | Betts et al. | 181/239 |
| 4,111,279 | A | * | 9/1978 | Sterrett | 181/264 |
| 4,119,174 | A | * | 10/1978 | Hoffman | 181/231 |
| 4,132,286 | A | | 1/1979 | Hasui et al. | |
| 4,235,304 | A | * | 11/1980 | Suyama | 181/265 |
| RE31,724 | E | * | 11/1984 | Isaka | 180/219 |
| 4,574,913 | A | * | 3/1986 | Fukuda | 181/231 |
| 4,941,545 | A | | 7/1990 | Wilcox et al. | |
| 4,972,921 | A | | 11/1990 | Takada et al. | |
| 5,025,890 | A | * | 6/1991 | Hisashige et al. | 181/272 |
| 5,581,056 | A | * | 12/1996 | Bellgardt et al. | 181/282 |
| 5,912,441 | A | * | 6/1999 | Worner | 181/282 |
| 6,571,911 | B1 | * | 6/2003 | Watanabe et al. | 181/265 |
| 6,619,426 | B1 | * | 9/2003 | Minami et al. | 181/251 |
| 6,629,580 | B1 | * | 10/2003 | Nilsson et al. | 181/265 |
| 6,681,889 | B1 | * | 1/2004 | Collmer et al. | 181/251 |

FOREIGN PATENT DOCUMENTS

| | | | |
|---|---|---|---|
| DE | 3837677 | A1 * | 6/1989 |
| DE | G 91 00 866.2 | | 1/1991 |
| DE | G 93 07 567.7 | | 5/1993 |

(Continued)

*Primary Examiner*—Edgardo San Martin

(57) ABSTRACT

An exhaust gas muffler of multi-chamber construction includes an outer housing having an upper and lower half shell, an inner shell, and an inner exhaust gas duct through the exhaust gas muffler. The inner exhaust gas duct has at lease one curved outlet pipe that has a first curved section and a straight outlet end runs flush with the outer housing. The invention also covers a method for the production of the multi-chamber exhaust gas muffler.

30 Claims, 7 Drawing Sheets

FOREIGN PATENT DOCUMENTS

| | | | | |
|---|---|---|---|---|
| DE | 4140429 | A1 | * | 6/1993 |
| DE | G 93 08 419.6 | | | 6/1993 |
| EP | 298379 | A1 | * | 1/1989 |
| EP | 816650 | A1 | * | 1/1998 |
| EP | 1101912 | A2 | * | 5/2001 |
| FR | 2 682 158 | | | 10/1991 |
| GB | 1 448 301 | | | 1/1974 |
| JP | 55043251 | A | * | 3/1980 |
| JP | 02099709 | A | * | 4/1990 |

* cited by examiner

MULTIPLE-CHAMBERED EXHAUST MUFFLER

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to an exhaust gas muffler in multi-chamber construction, particularly to an exhaust gas muffler of an automobile, with an outer housing consisting of an upper and a lower half shell, an inner shell, and also an internal exhaust gas conduction through the exhaust gas muffler.

TECHNICAL FIELD

Such an exhaust gas muffler is known from, for example, DE 196 27 079.0. It has two inner half shells, in which the internal exhaust gas duct is embossed and which constitute the inner partition walls of the chambers. An absorption chamber is provided above the upper horizontal partition, and a reflection chamber below the lower partition. The inner half shells are connected to the outer housing by a common curved edge section. The internal exhaust gas duct is S-shaped. Therefore a comparatively long internal exhaust gas path is provided in a compact exhaust gas muffler.

SUMMARY OF THE INVENTION

The invention has as its object to provide an exhaust gas muffler of the kind mentioned at the beginning, which as an after-muffler effects an optimum damping, even in the low frequency range, and is nevertheless of compact construction.

This object is attained by an exhaust gas muffler of multi-chamber construction, particularly an exhaust gas muffler of an automobile, comprising an outer housing having an upper and a lower half shell, an inner shell and an inner exhaust gas duct through the exhaust gas muffler, wherein the inner exhaust gas duct possesses at least one curved outlet pipe that has a first curved section and whose straight outlet end runs flush with the outer housing.

The nature of the invention is that the exhaust gas duct has at least one first curved outlet pipe which has a first curved section and whose preferably straight outlet end runs flush with the outer housing.

In particular, two curved outlet pipes are provided. The second curved outlet pipe likewise has a second curved section and a second preferably straight outlet end, the curved sections of the first outlet pipe and the second outlet pipe being directed toward each other in plan view, and preferably mutually crossing over at different heights in the exhaust gas muffler.

A particularly long length of outlet pipes can be implemented with respect to the outer dimension of an exhaust gas muffler when, in a further aspect of the invention, the outlet ends of the first outlet pipe and second outlet pipe are arranged in a horizontal plane parallel and at a close spacing to one another, at the outlet side of the exhaust gas muffler, and the inlet ends of the first outlet pipe and second outlet pipe are situated in a first reflection chamber in the laterally inner corner regions of the exhaust gas muffler at the oppositely placed inlet side of the exhaust gas muffler. Such a configuration, having an outlet pipe shape of a double "mammoth tooth" kind, damps in operation just those low-frequency growling noises which have been found to be particularly tiresome in an automobile. The muffler is nevertheless relatively small in size. The exhaust gas muffler according to the invention has no external end pipes, at least in the basic equipment; if need be, a cosmetic end diaphragm is inserted and fastened in the outlet ends of the outlet pipes. The exhaust gas muffler according to the invention, usable as an after-muffler, thus has an integrated outlet pipe extension just by means of the design of the curved sections.

The outlet pipes preferably have no jacket perforation.

For better fastening of the end diaphragm, the outlet pipes have a stepwise widened end; the ratio of the diameter of the outlet pipes to the diameter of the stepped widened end of the outlet pipes can advantageously be in the range of 40 to 52.

The compact exhaust gas muffler according to the invention is particularly provided as a four-chamber shell muffler with integrated outlet pipe extension.

A first and a second inner radial partition are then preferably formed in the interior of the exhaust gas muffler. The second partition allocated to the outlet side of the exhaust gas muffler extends over the whole inner cross section of the exhaust gas muffler and is secured to the outer housing.

Furthermore, an upper inner shell is situated on the inlet side of the exhaust gas muffler and extends as far as the second partition, to which it is secured. The upper inner shell is preferably anchored in a shell fold of the upper and lower half shells of the outer housing.

The first partition extends over the whole lower half shell cross section as far as the upper inner shell and in its turn is secured to the upper inner shell.

The space situated on the inlet side of the exhaust gas muffler, between the upper inner shell and the upper half shell of the outer housing as far as the second partition, is preferably filled with sound-absorbing material and therefore forms a first absorption chamber.

The space situated on the outlet side of the exhaust gas muffler, between the second partition and the outer housing, is appropriately likewise filled with a sound-absorbing material and in this manner represents a second absorption chamber.

The space situated on the inlet side of the exhaust gas muffler, between the upper inner shell and the lower half shell of the outer housing as far as the first partition, is an empty space and therefore forms a first reflection chamber.

A second reflection chamber is formed when the space between the upper inner shell and the lower half shell and also between the first and second partitions is likewise an empty space.

By "empty space" is to be understood a space that has no sound-absorbing material. It be understood that the outlet pipes mentioned at the beginning can run in this "empty space", equally also other portions of the internal gas ducts, in particular an inlet pipe.

The exhaust gas duct preferably has a straight inlet pipe, whose end situated on the outlet side of the exhaust gas muffler is located in the second absorption chamber.

The inlet pipe can have an at least partially perforated jacket and thereby be formed with passage openings at least to the first reflection chamber and to the second reflection chamber.

The first and second partitions have passage openings for the inlet pipe and the outlet pipes, the inlet pipe and the outlet pipes being secured at least to the first partition, preferably also to the second partition, at least in an alternative embodiment.

The first and second partitions and also the upper inner shell at least partially have perforated sections.

The inlet pipe can contain a bent inlet which runs flush with the outer housing.

In an alternative embodiment, the inlet pipe has a closed end in the second absorption chamber and also a jacket perforation in the region of the second absorption chamber.

In a further alternative embodiment, the inlet pipe has an open end in the second absorption chamber, the said end being arranged coaxially of, and with a peripheral spacing from, a deflecting pipe which is open on one side. The deflecting pipe is arranged in the second absorption chamber and fastened in a perforation of the second partition such that the annular outlet aperture of the deflecting pipe faces into the second reflection chamber. Here the annular outlet aperture can be situated in the plane of the second partition. In a further alternative, the deflecting pipe even extends into the second reflection chamber.

The deflecting pipe can have a perforated jacket and thereby be connected via passage openings to the second absorption chamber. Except for the perforations, the second absorption chamber and also the said first absorption chamber are completely closed and also gastightly sealed. They effect the known buffer damping.

An advantageous development of the invention provides that the inlet pipe has a tapered, stepped end section, at least in the region of the deflecting pipe. The cross section of the stepped end section of the inlet pipe is preferably equal to the cross section of the annular outlet aperture of the deflecting pipe.

Good flow properties are obtained when the deflecting pipe has a closed, cup-shaped deflecting end in the second absorption chamber on the outlet side of the exhaust gas muffler.

If in a preferred alternative embodiment, the exhaust gas muffler is fastened to a vehicle underfloor such that the first and second absorption chambers face toward the vehicle underfloor, not only is a good acoustic damping obtained in the direction of the vehicle interior, but also good heat insulation of the exhaust gas muffler, which is hot in operation, in the direction of the vehicle underfloor. This is particularly advantageous on a slow journey of a vehicle, namely when the wind of travel cannot sufficiently cool the exhaust gas muffler and nevertheless the two absorption chambers can keep the upper side at a comparatively low temperature level by the heat insulation according to the invention.

Summarizing, an after-muffler for an automobile, having an integrated end pipe extension, is thus in particular realized by means of the invention.

The essential design features are:

- four-chamber shell muffler with two absorption chambers with no throughflow and two reflection chambers with throughflow,
- chamber division by two transverse inner floors plus an inner shell anchored in the shell fold,
- inlet and outlet chamber are formed by the perforated inner shell plus two perforated inner floors with different cross section
- inlet pipe with three perforation blocks in the two reflection chambers or in the second absorption buffer chamber
- inlet pipe optionally with stepped inlet cross section plus backflow pipe anchored in the second inner floor
- elongation of the inner outlet pipe by special bends transversely of the long axis
- diameter ratio of the inner outlet pipes to the end pipes about 40 to 52.
- low surface temperatures in the direction of the vehicle floor by means of the two absorption chambers.

Furthermore, a particular advantage of the invention is the low outlet aperture sound level in muffler devices with extreme volume distribution between pre-muffler/middle muffler to after-muffler, for example, in a ratio of 15 to 85.

The invention furthermore relates to an exhaust gas muffler with a shell fold in the form of an bent peripheral fold and with two outer half shells, respectively with an edge, and also at least one inner shell with a flat edge, the edges of the outer shells being bent on the outside and connected together by means of the peripheral fold and the flat edge of the inner shell(s) being clamped firmly between the edges of the outer half shells.

The invention furthermore relates to a method of production of a muffler.

A muffler of the kind is known from European Patent Document EP 0 664 380 A1 with outer shells having bent edges that form a clamping crimp in the assembled state of a housing shell. The flat edge of the inner shell is dimensioned such that it closely contacts the wall of the housing shell and is only resiliently retained between the local clamping crimps. The clamping crimps are already embossed in during the prefabrication of the outer shell halves. The embossing depth of the clamping crimp is predetermined by the thickness of the inner shell. It is a disadvantage that the position and depth of the clamping crimp in the embossing tool must be determined. After the position and depth of the clamping crimps has been determined, the peripheral fold can be formed only unchanged in the same configuration and the inner shell only with a constant thickness that permits no tolerances, if the clamping action is not to be impaired. The local clamping crimps also permit no sealing of the inner shell with respect to the outer shell.

In contrast, a development according to the invention provides in particular that an inner shell has a variable thickness within certain tolerances and a longitudinal extent not over the whole axial length of the muffler; that the edges of the outer half shells are formed flat; and that the flat edge of the inner shell(s) is securely clamped by the bent peripheral fold between the flat edges of the outer half shells only in a partial region of the peripheral fold. The inner shell, not bound in and sealed over the entire periphery in the peripheral fold of the outer half shells, thus has a flat edge which is bound in partially in a quite conventional bent peripheral fold, as is state of the art for outer half shells and easy to produce. The peripheral fold according to the invention is characterized by two different designs over the entire peripheral length, with the same basic combination. The peripheral fold partially retains, clamped in between, a flat edge of an inner shell or respectively two edges of two inner shells, the inner shell(s) being sealed with respect to the outer half shells and with respect to at least one further inner partition of the exhaust gas muffler. For the other portion, it is purely a closure of the two outer half shells. The inner shell can have a different thickness within certain limits, without impairing the clamping and sealing effect of the inner shell and the outer shells. The partial folding-in of the inner shell(s) advantageously makes the formation of at least one additional chamber in a shell muffler possible.

The bent peripheral fold can preferably be formed downward and have a simply overwrapped upper end of an upper half shell. This alternative embodiment permits external liquid to flow down at the peripheral fold and therefore not penetrate into the interior of the muffler from outside.

The bent peripheral fold has in particular an upper reverse bend. This alternative is particularly advantageous for the production of a larger region of an effective prestress force or pressing force of the flat edges of the outer half shells either directly against one another or indirectly against one another with the interposition of the flat edge of the inner shell, a good sealing effect being given in both cases, even with different thickness of an inner shell.

At least the outer half shells and the bent peripheral fold can be formed double-walled, which makes different muffler alternatives possible with the same peripheral fold constitution.

An outer half shell can have an inner floor which is turned up at the edge over a radius and sealingly borders on the underside of the inner shell.

It is particularly advantageous, in a method according to the invention for the production of a muffler with a peripheral fold of the said kind, if the prefabricated outer half shells, with the interposition of at least one prefabricated inner shell only in a partial region of the outer half shells and after building in if necessary further individual parts, are assembled and pre-fixed with their flat edges, and wherein the bent peripheral fold is formed in a single process step with a preferably single peripheral fold tool, the peripheral fold tool being guided and driven on the flat edges between the inlet and outlet aperture of the pre-fixed exhaust gas muffler. Short production times are thus given for a muffler of multi-chamber construction.

BRIEF DESCRIPTION OF THE DRAWINGS

The invention is described in detail hereinafter, using embodiments and with reference to the accompanying drawing.

DETAILED DESCRIPTION OF THE INVENTION

Figure 1:
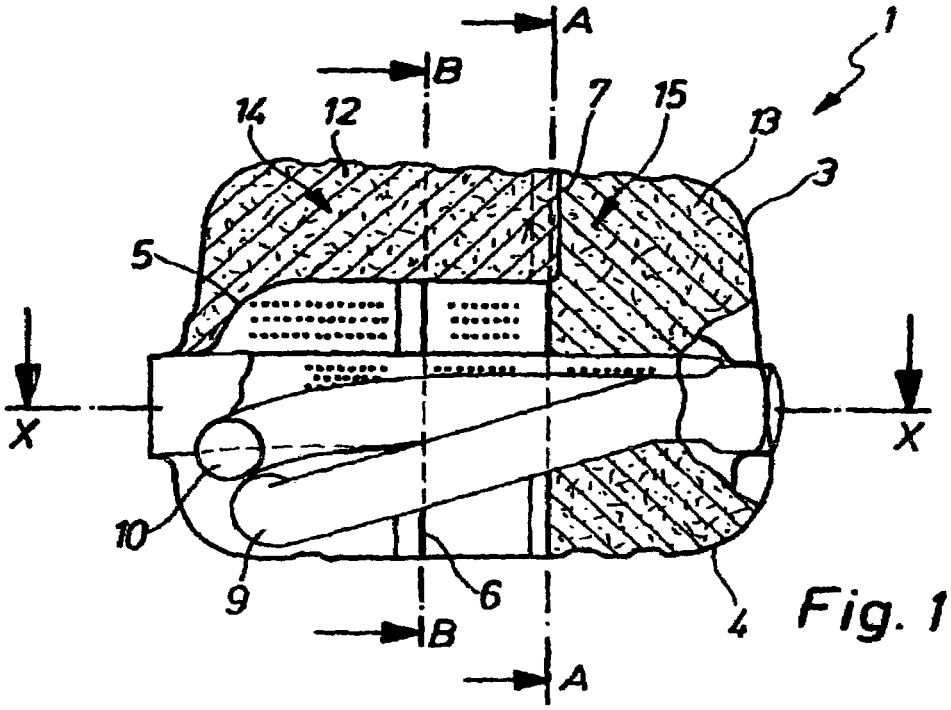
FIG. 1 is a schematic diagram of an exhaust gas muffler of four-chamber construction in half shell technique, in a vertical section.

According to FIGS. 1–5, an automobile exhaust gas muffler 1 of four-chamber construction includes an outer housing 2.

The outer housing 2 consists of an upper half shell 3 and a lower half shell 4, which are secured together in their horizontal plane by means of a shell fold 25. An upper inner shell 5 is furthermore fastened in the shell fold 25. An internal exhaust gas duct extends through the exhaust gas muffler 1.

The exhaust gas duct has two curved outlet pipes 9, 10, which are arranged in the interior of the exhaust gas muffler 1.

Figure 2:
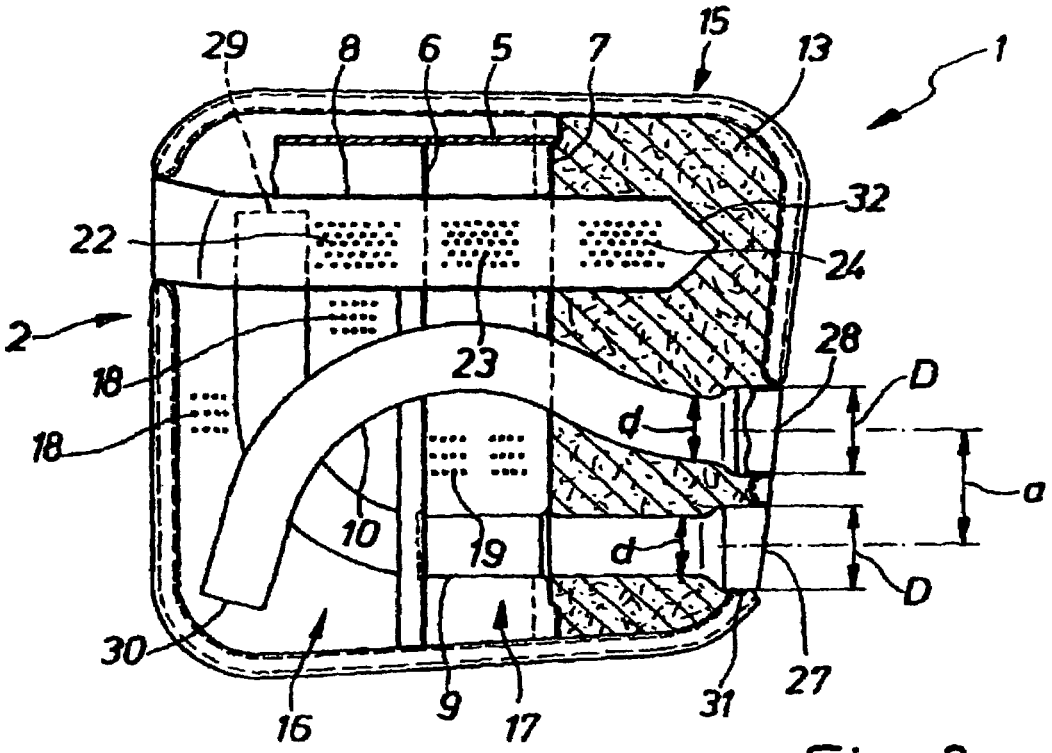
FIG. 2 is a diagram of the exhaust gas muffler of FIG. 1, in a horizontal section along the line X—X.
Figure 3:
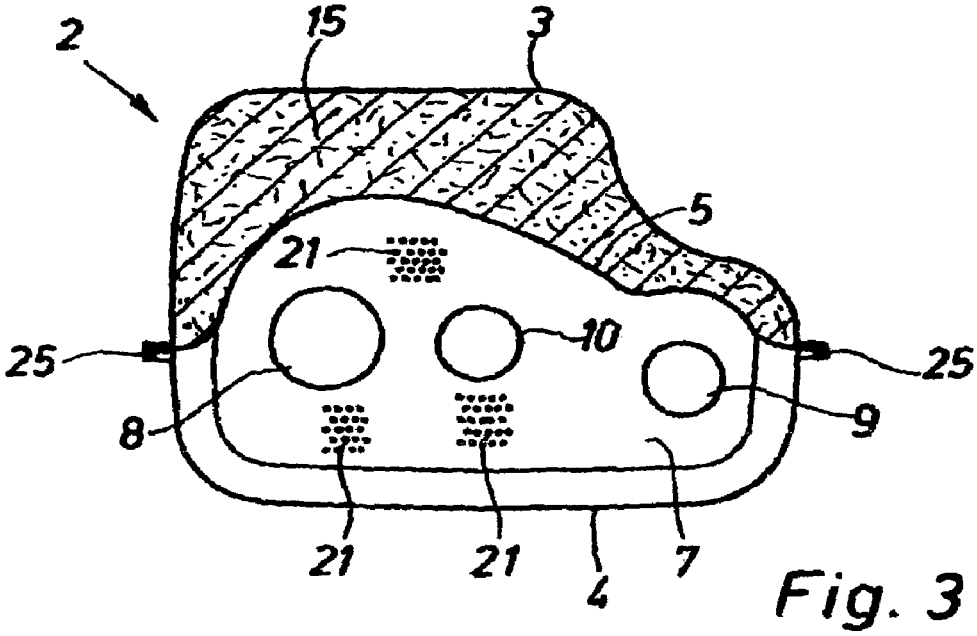
FIG. 3 is a diagram of the exhaust gas muffler of FIG. 1, in a cross section along the line A—A.
Figure 4:
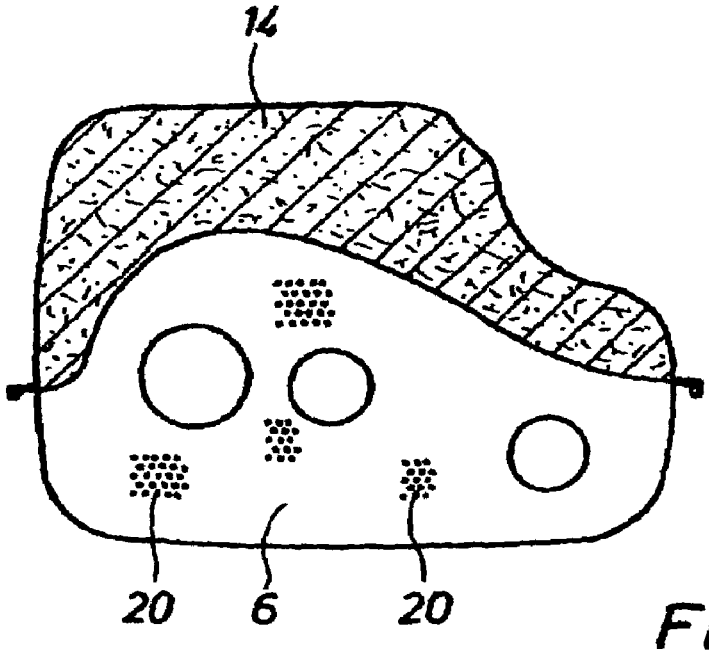
FIG. 4 is a diagram of the exhaust gas muffler of FIG. 1, in a cross section along the line B—B.

The first curved outlet pipe 9 is the left-hand outlet pipe and has a first curved section, which is curved to the right in the plan view of FIG. 2. The outlet end 27 is situated in the left-hand rear corner of the exhaust gas muffler 1. The first outlet pipe 9 extends from behind in a straight line in the muffler interior. The curved suction describes an arc of 90°. The inlet section of the outlet pipe 9 is again straight. The inlet end 29 is situated, according to FIG. 2, in about the right-hand forward corner of the muffler interior on the inlet side of the exhaust gas muffler. The outlet end 27 runs flush with the outer housing 2 and has a stepped widened end 31.

The second curved outlet pipe 10 is in principle constructed like the first curved outlet pipe 9. Correspondingly, it has a straight outlet end 28 which likewise has a stepped widened end 31, and also a second curved section which according to FIG. 2 extends from behind, first to the right and then in about a 90° arc to the left in the muffler interior in the other left-hand corner in the interior of the muffler on the inlet side of the exhaust gas muffler.

The curved sections of the first outlet pipe 9 and second outlet pipe 10 are thus directed toward one another in plan view and cross without contact at different heights in the exhaust gas muffler.

The outlet ends 27, 28 of the first outlet pipe 9 and second outlet pipe 10 are parallel at the outlet side of the exhaust gas muffler and are arranged in a horizontal plane at a close spacing a from one another. The inlet ends 29, 30 of the first outlet pipe 9 and second outlet pipe 10 are situated on the opposite inlet side of the exhaust gas muffler in the lateral inner corner regions of the exhaust gas muffler in a first reflection chamber 16, which is described hereinafter.

Both outlet pipes 9, 10 have an unperforated jacket.

The ratio of the diameter d of the outlet pipes 9, 10 to the diameter D of the stepped widened end 31 of the outlet pipes is in the region of 40 to 52.

The exhaust gas muffler 1 furthermore includes a first and a second internal radial partition 6, 7, the second partition 7 allocated to the outlet side of the extending over the whole internal cross section of the exhaust gas muffler 1 and being secured to the outer housing 2.

The upper inner shell 5 already mentioned is located on the inlet side of the exhaust gas muffler interior and extends as far as the second partition 7, to which is it secured.

The first partition 6 extends over the whole lower half shell cross section as far as the upper inner shell 5 and is secured to the upper inner shell.

The space situated on the inlet side of the exhaust gas muffler 1 between the upper inner shell 5 and the upper half shell 3 of the outer housing 2 as far as the second partition 7 is filled with a first sound-absorbing material. It forms a first absorption chamber 14.

The space situated on the outlet side of the exhaust gas muffler 1 between the second partition 7 and the outer housing 2 is filled with a second sound-absorbing material. It forms a second absorption chamber 15.

The space situated on the inlet side of the exhaust gas muffler 1 between the upper inner shell 5 and the lower half shell 4 of the outer housing 2 as far as the first partition 6 is an empty space. It forms the already mentioned first reflection chamber 16.

The space between the upper inner shell 5 and the lower half shell 4 of the outer housing 2 and also between the first and second partitions 6, 7 is likewise an empty space. It forms a second reflection chamber 17.

The internal gas duct of the exhaust gas muffler 1 furthermore has a straight inlet pipe 8 on the inlet side, on the left-hand side in FIG. 2, of the exhaust gas muffler 1. The inlet pipe 8 has, on the right-hand outlet side in FIG. 2 of the exhaust gas muffler 1, a blind end 32 ending in the second absorption chamber 15.

The inlet pipe 8 has its jacket at least partially perforated, and thereby has passages openings 22, 23 at least to the first reflection chamber 16 and to the second reflection chamber 17.

The first and second partitions 6, 7 have passage openings for the inlet pipe 8 and the outlet pipes 9, 10, the inlet pipe and the outlet pipes being secured to the first partition 6 and to the second partition 7.

The first and second partitions 6, 7 and also the upper inner shell 5 furthermore at least partially include perforations 18, 19, 20, 21.

The inlet pipe 8 has a bent inlet which runs flush with the outer housing 2.

It is thus apparent that in operation exhaust gas can flow through the exhaust gas muffler 1. The exhaust gas passes through the inlet pipe 8 and through the first jacket perforation 22 into the first reflection chamber 16 and also through the second jacket perforation 23 into the second reflection chamber 17, and from there through the perforation 20 of the first partition 6 into the first reflection chamber 16.

Furthermore, exhaust gas passes through the jacket perforations 24 into the second absorption chamber 15.

Furthermore exhaust gas passes through the perforation 18 of the upper inner shell 5 from the first reflection chamber 16 and also through the perforation 19 of the upper inner shell 5 from the second reflection chamber into the first absorption chamber 14.

The exhaust gas present in the first reflection chamber is conducted out by means of the two long, curved outlet pipes 9, 10 from the interior of the exhaust gas muffler, to the right according to the drawing, as far as the outlet end, and from there in practice into the atmosphere, since muffler outer end pipes are no longer provided, but still diaphragms if need be, which improve the visual appearance of the muffler device.

Figure 5:
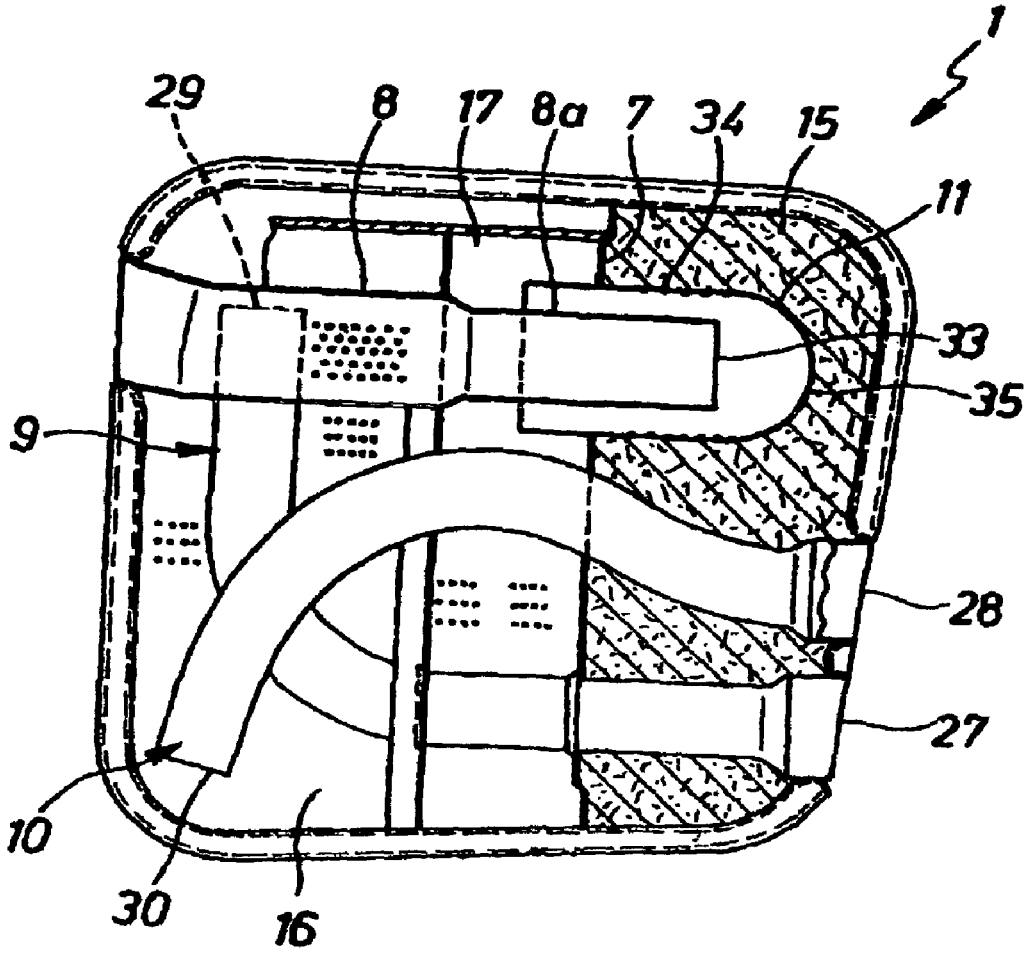
FIG. 5 is a diagram of another exhaust gas muffler, in a horizontal section similar to FIG. 2.
Figure 6:
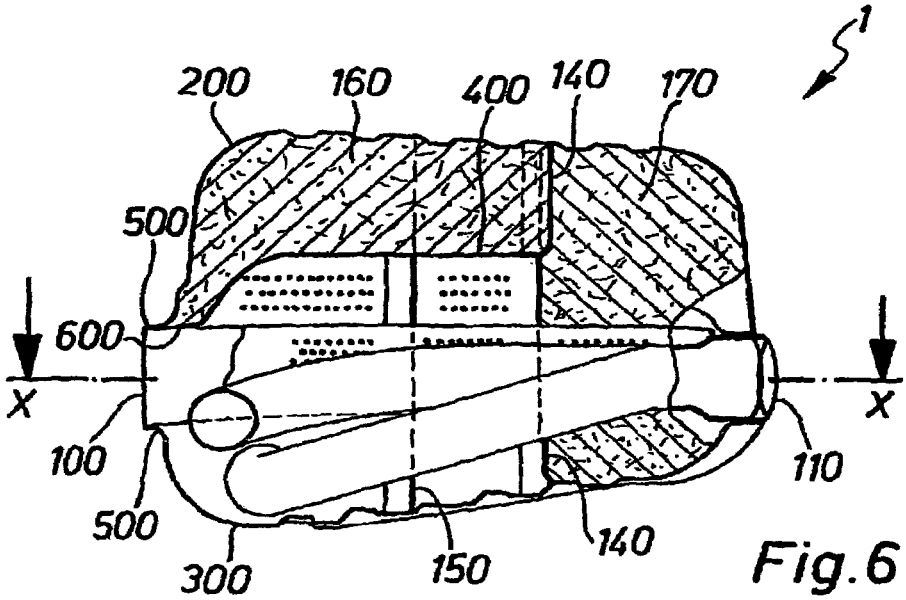
FIG. 6 is a schematic diagram of an exhaust gas muffler of four-chamber construction in half shell technique, in a vertical section.
Figure 7:
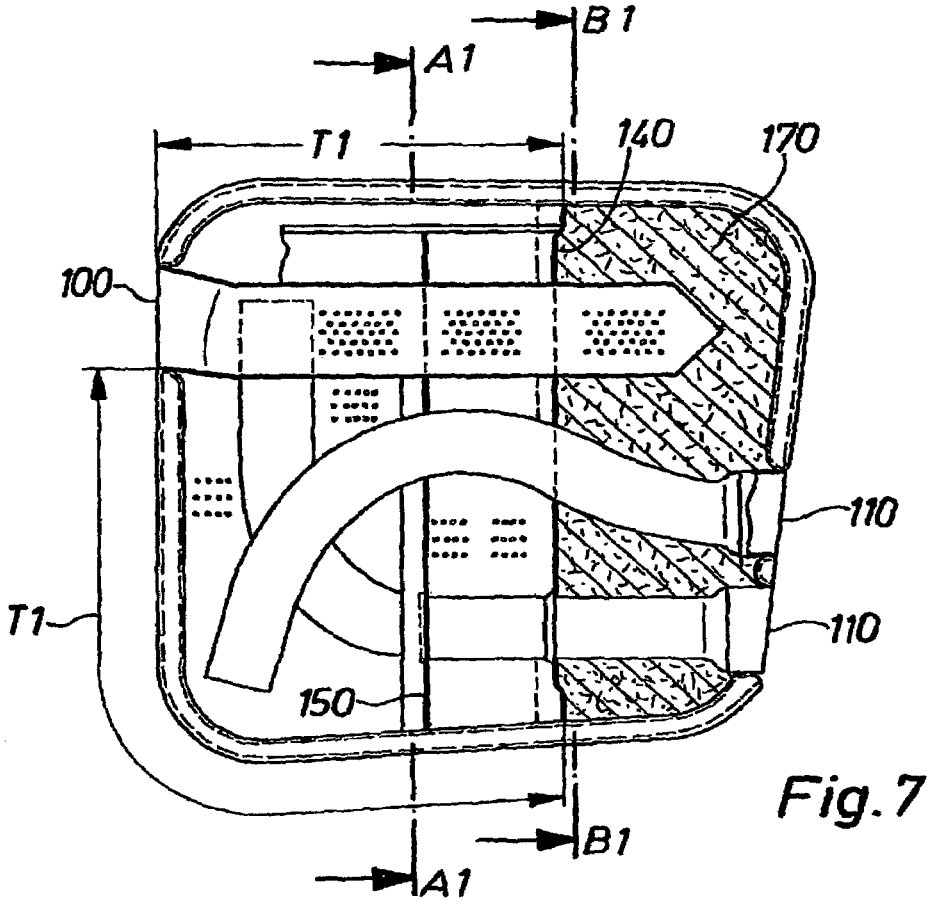
FIG. 7 is a diagram of the exhaust gas muffler of FIG. 6, in a horizontal section along the line X—X.
Figure 8:
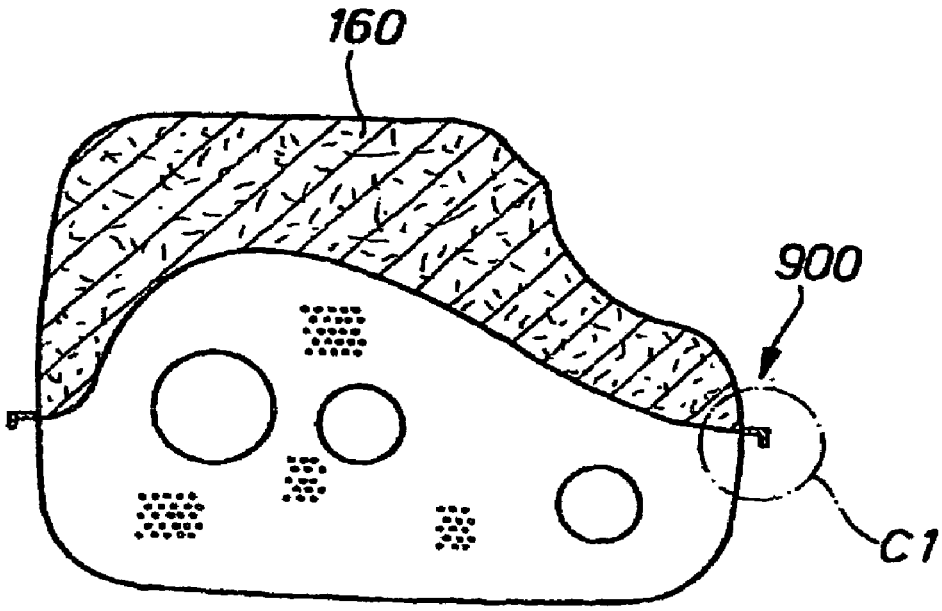
FIG. 8 is a diagram of the exhaust gas muffler of FIG. 7, in a cross section along the line A1—A1.
Figure 9:
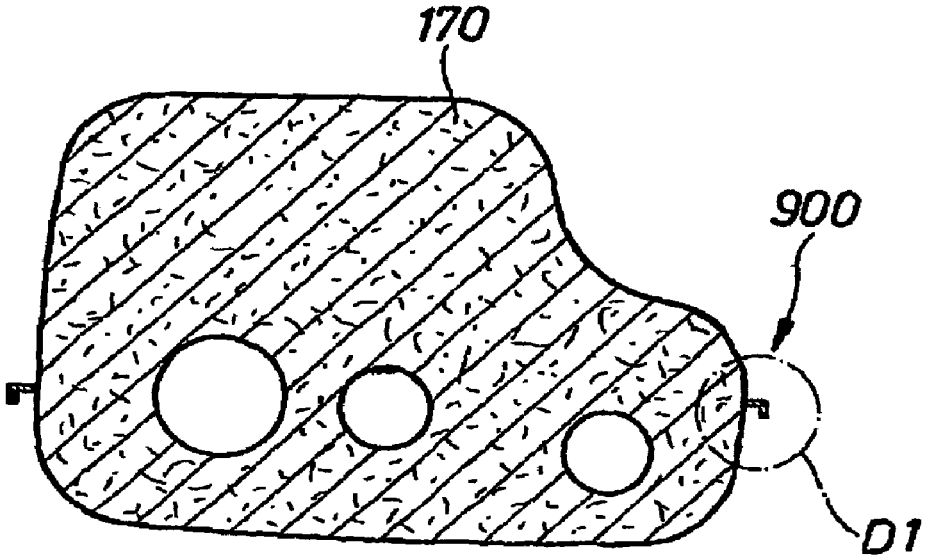
FIG. 9 is a diagram of the exhaust gas muffler of FIG. 7, in a cross section along the line B1—B1.

Another embodiment of an inlet pipe 8 is shown in FIG. 5. The remaining portions of the exhaust gas muffler correspond to the alternative embodiment according to FIGS. 1–4. The same portions are therefore given the same reference numerals.

The inlet pipe 8 according to FIG. 5 has no blind end on the right-hand side in the second absorption chamber 15 as in the first-mentioned embodiment example, but has an open front end 33. The end 33 is situated coaxially and with a peripheral spacing in a deflecting pipe 11, which is open on one side.

The deflecting pipe 11 is arranged in the second absorption chamber 15 and is secured in an opening of the second partition 7. The annular opening of the deflecting pipe 11 faces into the second reflection chamber 17. The deflecting pipe 11 has a perforated jacket and therefore has passage openings 34 to the second absorption chamber 15. The inlet pipe 8 has a tapered, stepped end section 8*a*, at least in the region of the deflecting pipe 11. The cross section of the stepped end section 8*a* of the inlet pipe 8 is equal to the cross section of the annular outlet opening of the deflecting pipe 11. The deflecting pipe 11 has a closed, cup-shaped deflecting end 35 in the second absorption chamber 15 on the outlet side of the exhaust gas muffler.

The alternative embodiment of FIG. 5 accordingly has good flow properties in the region of the inlet pipe. The flow resistance to the exhaust gas flowing through is comparatively low. The arrangement is primarily suitable for low-powered internal combustion engines.

It is particularly advantageous if the exhaust gas muffler is fastened to a vehicle underfloor so that the first and the second absorption chamber 14, 15 face in the direction of the vehicle underfloor, i.e., are located in the neighborhood of the vehicle underfloor, and heat insulation thereby exists toward the vehicle underfloor. The hot opposite wall of the muffler, in contrast, faces toward the ground on which the vehicle moves. In this manner, the vehicle underfloor is not overheated, even in slow travel or when the vehicle is stationary, i.e., in cases in which there is no, or only a little, cooling by the wind of travel.

According to FIGS. 6–11, an automobile exhaust gas muffler 1 of four-chamber construction includes an outer housing which consists of an upper half shell 200 and a lower half shell 300, which are secured together in their horizontal parting plane by means of a bent peripheral fold 900.

An upper inner shell 400 is furthermore partially fastened in the peripheral fold 900, as is described below.

The internal gas ducting, with the two curved outlet pipes, extends through the exhaust gas muffler 1.

The exhaust gas muffler 1 furthermore includes a first inner radial partition 150 and a second internal radial partition 140; the second partition 140, allocated to the outlet side of the exhaust gas muffler, extends over the whole inner cross section of the exhaust gas muffler 1 and is secured to the outer housing.

The inner shell 400, already mentioned, is located on the inlet side of the exhaust gas muffler interior and extends as far as the second partition 140, with which it is securely connected.

The first partition wall 150 extends over the whole lower half shell cross section as far as the upper inner shell 400 and is secured to the upper inner shell.

The space situated on the inlet side of the exhaust gas muffler 1 between the upper inner shell 400 and the upper outer half shell 200 of the outer housing as far as the second partition 140 is filled with a first sound-absorbing material. It forms a first absorption chamber 160.

The space situated on the outlet side of the exhaust gas muffler 1 between the second partition 140 and the outer housing is filled with a second sound absorbing material. It forms a second absorption chamber 170.

The space situated on the inlet side of the exhaust gas muffler 1 between the upper inner shell 400 and the lower half shell 300 of the outer housing as far as the first partition 150 is an empty space. It forms a first reflection chamber.

The space between the upper inner shell 400 and the lower outer half shell 300, and also between the first and second partitions 150, 140, is likewise an empty space. It forms a second reflection chamber.

Figure 10:
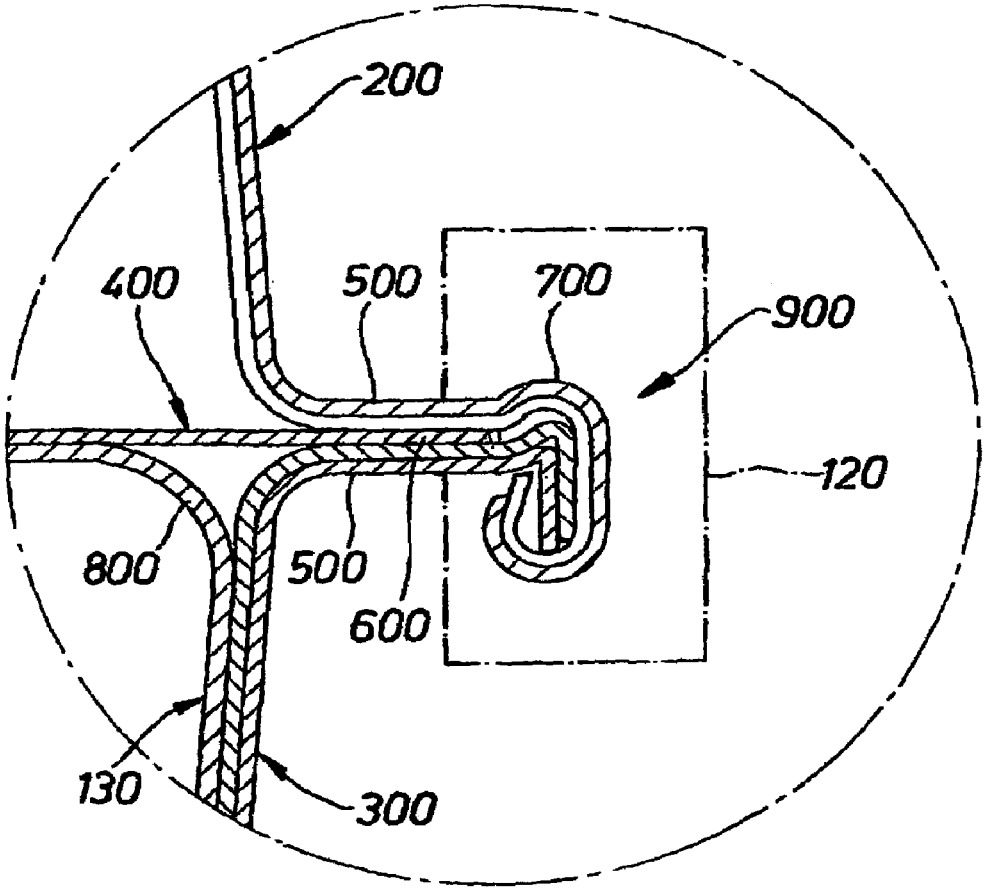
FIG. 10 is an enlarged diagram of the detail C1 of FIG. 8 of a peripheral fold in the partial region of an interposed arrangement of an inner shell.
Figure 11:
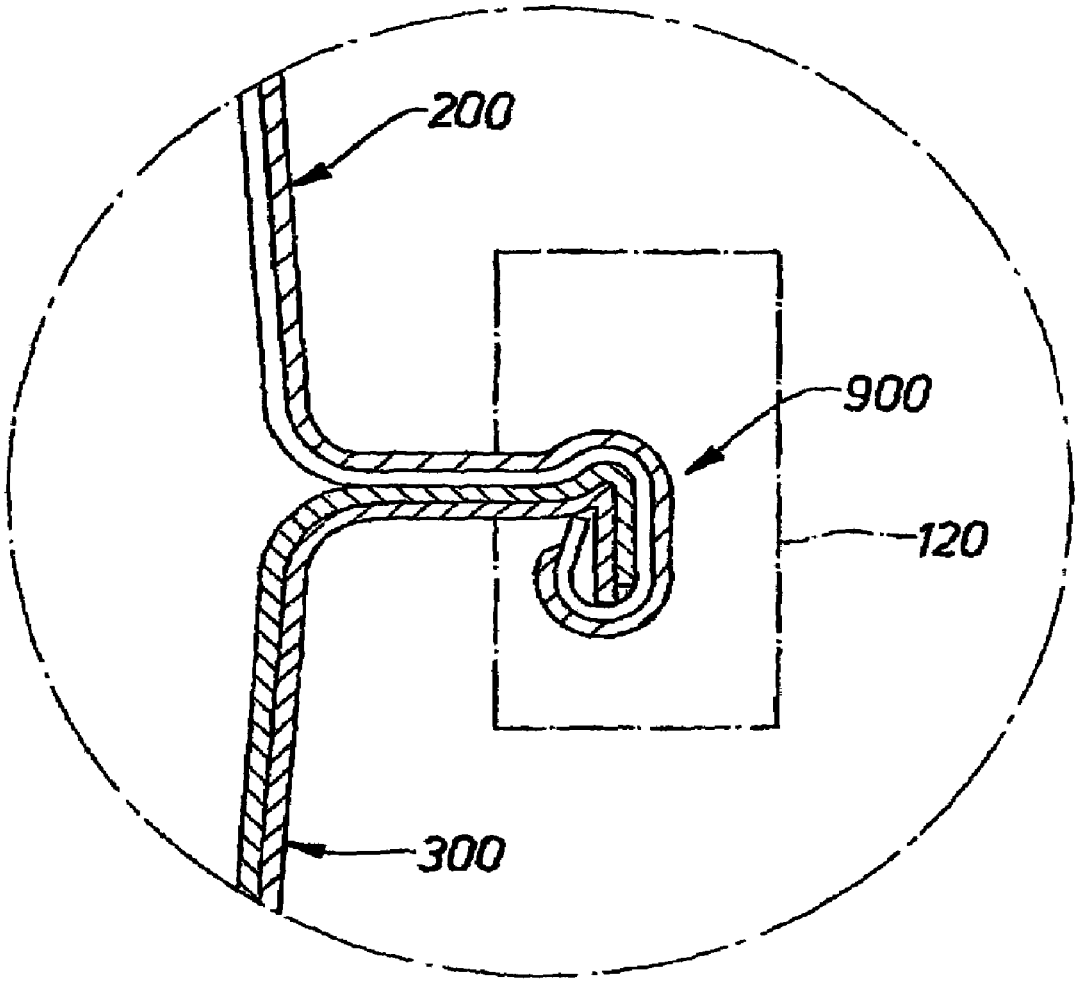
FIG. 11 is an enlarged diagram of the detail D1 of FIG. 9 of a the same peripheral fold without the interposed arrangement of an inner shell.

As can be seen in greater detail in FIGS. 10 and 11, the said automobile exhaust gas muffler 1, of multi-chamber construction, has two outer half shells 200, 300, respectively with an edge 500 and also an inner shall 400 with a flat edge 600; the edges 500 of the outer half shells 200, 300 being bent outside and therefore connected together in this manner by means of the peripheral fold 900, and the flat edge 600 of the inner shell 400 being securely clamped partially between the edges 500 of the outer half shells.

In particular, the edges of the outer half shells 200, 300 are made flat, and the flat edge 600 of the inner shell 400 is securely clamped in between the flat edges 500 of the outer half shells by the bent peripheral fold 900 only in a partial region T1 of the peripheral fold 900. In a region in which the inner shell 400 is no longer clamped, the two flat edges 500 of the outer half shells 200, 300 are directly clamped against each other and form an additional sealing region in addition to the bent peripheral fold 900 according to FIG. 11.

The bent peripheral fold 900 is formed downward and has a single overwrapped edge of the outer half shell 200.

The bent peripheral fold 900 has an upper counter-bend 700.

Both outer half shells 200, 300, including the peripheral fold 900, are of double-walled construction.

The lower outer half shell 300 has an inner floor 130 which is turned up over a radius 800 and which sealingly borders on the underside of the inner shell 400.

A said peripheral fold 900 is primarily formed as follows in an exhaust gas muffler 1.

The prefabricated outer half shells 200, 300 are assembled in position with interposition of the prefabricated inner shell 400 only in a partial region T1 of the outer half shells 200, 300 and after building in the remaining individual portions with their flat edges 500, 600 according to FIGS. 6–9, and are pre-fixed by means of a fastening arrangement (not illustrated). A peripheral fold tool 120 is then set on the flat edges 500, 600, as schematically shown by chain lines in FIGS. 10 and 11. The set peripheral fold tool 120 is driven and guided along the flat edges 500, or 500, 600, between the inlet aperture 100 and the outlet aperture 110 of the exhaust gas muffler 1 prefixed by the fastening arrangement, in order to form the bent peripheral fold 900 according to FIGS. 10 and 11 in a single process step. After formation of the bent peripheral fold 900 on the whole periphery of the exhaust gas muffler 1 on both sides of the exhaust gas muffler according to FIG. 7 between the inlet aperture 100 and the outlet apertures 110, the exhaust gas muffler 1 is finally taken out of the released fastening arrangement.

The said pre-fixing of the exhaust gas muffler 1 can also take place by positively interengaging raised and sunken regions of the outer half shells and the inner shell(s), particularly in the region of the inlet opening 100 and/or the outlet opening 110. It may then be possible to dispense with a separate fastening arrangement.

The invention claimed is:

1. The exhaust gas muffler of an automobile (1) of multi-chamber construction, comprising an outer housing (2) consisting of an upper and a lower half shell (3, 4), an inner shell (5), and also an inner exhaust gas duct through the exhaust gas muffler, wherein the inner exhaust gas duct possesses at least one curved outlet pipe (9) which has a first curved section and whose preferably straight outlet end (27) runs flush with the outer housing (2); wherein a second curved outlet pipe (10) with a second curved section and a second preferably straight outlet end (28) is provided; the curved sections of the first outlet pipe (9) and second outlet pipe (10) are directed toward each other in plain view.

2. Exhaust gas muffler according to claim 1, wherein the curved sections of the first outlet pipe (9) and the second outlet pipe (10) cross over one another at different heights in the exhaust gas muffler.

3. Exhaust gas muffler according to claim 2, wherein the outlet ends (27, 28) of the first outlet pipe (9) and of the second outlet pipe (10) are arranged on the outlet side of the exhaust gas muffler, parallel and at a close mutual spacing (a) in a horizontal plane, and the inlet ends (29, 30) of the first outlet pipe (9) and of the second outlet pipe (10) are located in the lateral inner corner regions of the exhaust gas muffler in a first reflection chamber (16).

4. Exhaust gas muffler according to claim 1, wherein the outlet pipes (9, 10) have an unperforated jacket.

5. Exhaust gas muffler according to claim 1, wherein the outlet pipes (9, 10) has a stepped, widened end (31).

6. Exhaust gas muffler according to claim 5, wherein the ratio of the diameter (d) of the outlet pipes (9, 10) to the diameter (D) of the stepped, widened end (31) of the outlet pipes is in the region of 40–52.

7. Exhaust gas muffler according to claim 1, wherein a first and a second inner radial partition (6, 7) are provided, the second partition (7), being allocated to the outlet side of the exhaust gas muffler, extending over the whole inner cross section of the exhaust gas muffler (1) and being securley connected to the outer housing (2).

8. Exhaust gas muffler according to claim 7, wherein an upper inner shell (5) is provided on the inlet side of the exhaust gas muffler, extends as far as the second partition (7), and is securely connected to the second partition, and preferably is anchored in a shell fold (25) of the upper and lower half shells (3, 4) of the outer housing.

9. Exhaust gas muffler according to claim 8, wherein the first partition (6) extends over the whole lower half shell cross section as far as to the upper inner shell (5) and is secured to the upper inner shell.

10. Exhaust gas muffler according to claim 9, wherein the space situated on the inlet side of the exhaust gas muffler between the upper inner shell (5) and the upper half shell (3) of the outer housing (2) as far as the second partition (7) is filled with sound absorbing material and forms a first absorption chamber (14).

11. Exhaust gas muffler according to claim 9, wherein the space situated on the outlet side of the exhaust gas muffler between the second partition (7) and the outer housing (2) is filled with a second sound-absorbing material and forms a second absorption chamber (15).

12. Exhaust gas muffler according to claim 9, wherein the space situated on the inlet side of the exhaust gas muffler between the upper inner shell (5) and the lower half shell (4) of the outer housing (2) as far as the first partition (6) is an empty space and forms the first reflection chamber (16).

13. Exhaust gas muffler according to claim 9, wherein the space between the upper inner shell (5) and the lower half shell (4) of the outer housing and also between the first and second partitions (6, 7) is an empty space and forms a second reflection chamber (17).

14. Exhaust gas muffler according to claim 11, wherein the exhaust gas duct has a preferably straight inlet pipe (8), whose end situated on the outlet side of the exhaust gas muffler is located in the second absorption chamber (15).

15. Exhaust gas muffler according to claim 14, wherein the inlet pipe (8) has an at least partially perforated jacket and thereby possess passages (22, 23) at least to the first reflection chamber (16) and to the second reflection chamber (17).

16. Exhaust gas muffler according to claim 14, wherein the first and second partitions (6, 7) have passage openings for the inlet pipe (8) and the outlet pipes (9, 10), the inlet pipe and the outlet pipes being secured at least to the first partition (6).

17. Exhaust gas muffler according to claim 8, wherein the first and second partitions (6, 7) and also the upper inner shell (5) at least partially have perforations (18, 19, 20, 21).

18. Exhaust gas muffler according to claim 14, wherein the inlet pipe (8) has a bent inlet which runs flush with the outer housing (2).

19. Exhaust gas muffler according to claim 14, wherein the inlet pipe (8) possesses a closed end (32) in the second absorption chamber (15) and also a jacket perforation (24) in the region of the second absorption chamber (15).

20. Exhaust gas muffler according to claim 14, wherein the inlet pipe (8) possesses an open front end (33) in the second absorption chamber (15), arranged coaxially and with a peripheral spacing in a deflecting pipe (11) which is open on one side and is its turn is secured in an opening of the second partition (7), and the annular outlet opening of the deflecting pipe (11) faces into the second reflection chamber (17).

21. Exhaust gas muffler according to claim 20, wherein the deflecting pipe (11) has a perforated jacket and thereby possesses passages (34) to the second absorption chamber (15).

22. Exhaust gas muffler according to claim 20, wherein the inlet pipe (8) possesses a tapered, stepped end section (8*a*) at least in the region of the deflecting pipe (11).

23. Exhaust gas muffler according to claim 22, wherein the cross section of the stepped end section (8*a*) of the inlet pipe is equal to the cross section of the annular outlet opening of the deflecting pipe (11).

24. Exhaust gas muffler according to claim 20, wherein the deflecting pipe (11) possesses a closed, cup-shaped deflecting end on the outlet side of the exhaust gas muffler in the second absorption chamber (15).

25. Exhaust gas muffler according to claim 11, wherein this can be secured to a vehicle underfloor such that the first and the second absorption chambers (14, 15) face in the direction of the vehicle underfloor.

26. Exhaust gas muffler according to claim 8, with a shell fold in the form of a bent peripheral fold (900) and with two outer shells (200, 300) respectively with an edge (500) and also at least one inner shell (400) with a flat edge (600); the edges (500) of the outer half shells (220, 300) being bent on the outside and connected together by means of the peripheral fold (900), and the flat edge (600) of the inner shell(s) (400) being clamped between the edges (500) of the outer half shells, wherein the edges (500) of the outer half shells (200, 300) are made flat, and the flat edge (600) of the inner shells(s) (400) between the flat edges (500) of the outer half shells is securely clamped by the bent peripheral fold (900) only in a partial region (T1) of the peripheral fold (900).

27. Muffler according to claim 26, wherein the bent peripheral fold (900) is formed downward and has a simply overwrapped upper edge of an upper half shell (200).

28. Muffler according to claim 27, wherein the bent peripheral fold (900) has an upper reverse bend (700) or upper counter-bend.

29. Muffler according to claim 26, wherein at least the outer half shells (200, 300) and the bent peripheral fold (900) are formed double-walled.

30. Muffler according to claim 26, wherein a lower outer half shell (400) has an inner floor (130) which is turned up over a radius (800) at the edge and which sealingly borders on the underside of the inner shell (400).

* * * * *